United States Patent [19]

McGee

[11] 4,210,373

[45] Jul. 1, 1980

[54] GROUND CLAMP FOR WELDING APPARATUS

[76] Inventor: Norris E. McGee, 929 Day Ave., Bakersfield, Calif. 93308

[21] Appl. No.: 40,754

[22] Filed: May 21, 1979

[51] Int. Cl.[2] ..... H01R 11/26

[52] U.S. Cl. ..... 339/8 R; 339/12 R; 339/264 R

[58] Field of Search ..... 339/95 R, 109, 264, 339/12, 8

[56] References Cited

U.S. PATENT DOCUMENTS

| | | | |
|---|---|---|---|
| 2,420,895 | 5/1947 | Merriman | 339/264 R |
| 2,796,592 | 6/1957 | Borel | 339/109 |
| 3,268,853 | 8/1966 | Noker et al. | 339/264 R |
| 4,159,161 | 6/1979 | Timmer | 339/264 R |

*Primary Examiner*—Joseph H. McGlynn

*Attorney, Agent, or Firm*—Poms, Smith, Lande & Rose

[57] ABSTRACT

A ground clamp for rotatably connecting a welding cable to a workpiece which permits the workpiece to be rotated during welding while the portion of the clamp to which the cable is clamped remains substantially stationary so that the cable is not wrapped around the workpiece. The clamp may be secured to workpieces of differing configurations.

10 Claims, 3 Drawing Figures

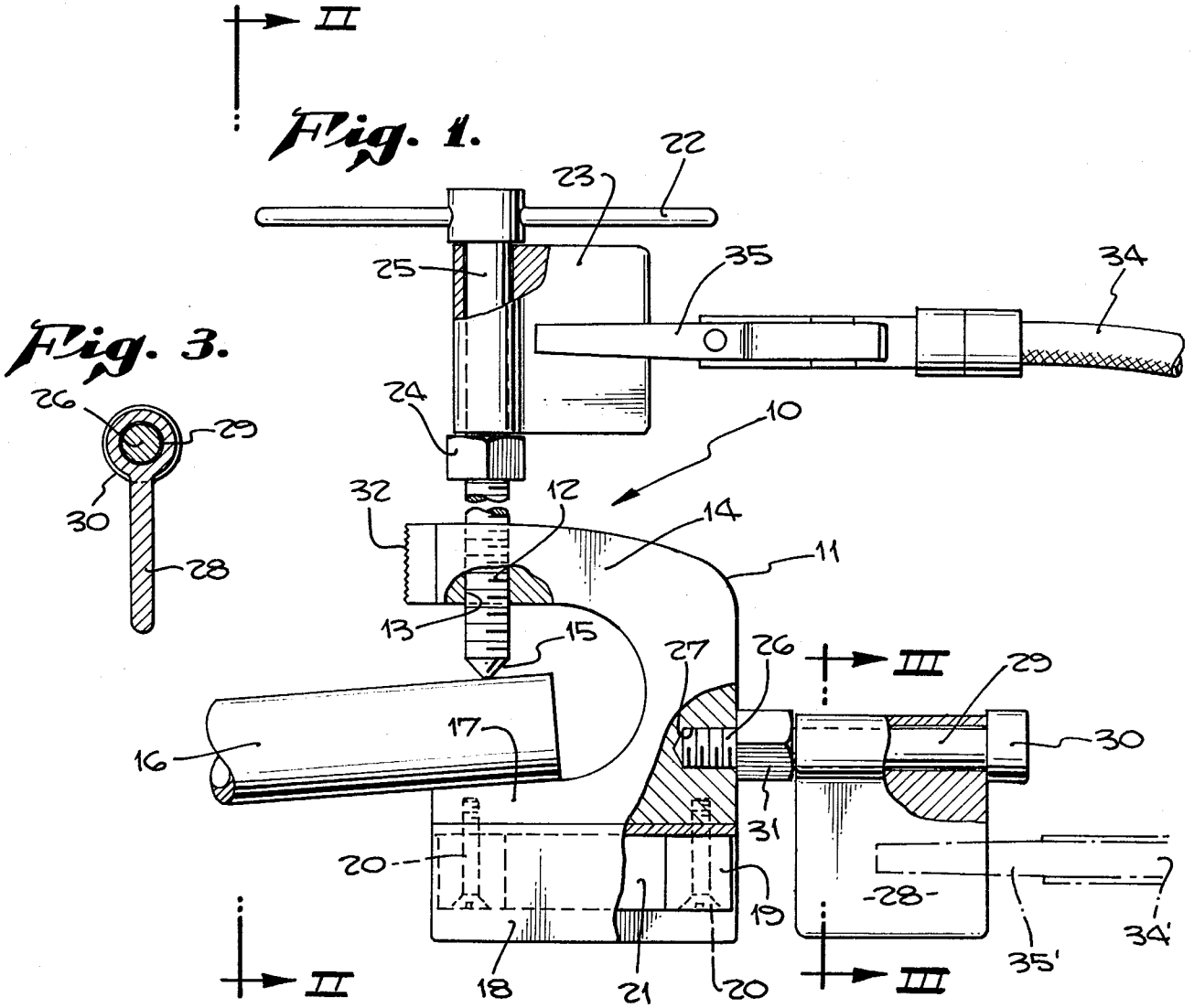
Fig. 1.
Fig. 3.
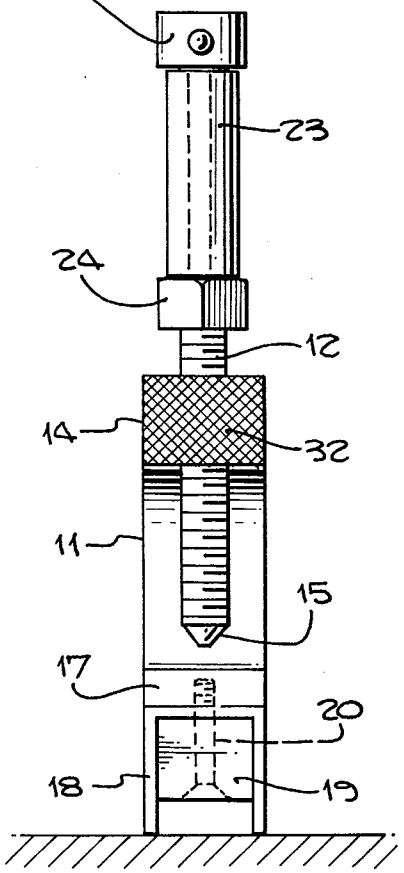
Fig. 2.

GROUND CLAMP FOR WELDING APPARATUS

BACKGROUND OF THE INVENTION

1. Field of the Invention

The invention relates to ground clamps; and, more particularly, to a ground clamp for use in welding workpieces which permits the workpiece to be rotated during welding.

2. Description of the Prior Art

In electric welding, a workpiece being welded must be connected to the ground conductor or cable of an electrical welding apparatus. This is accomplished by means of a ground clamp connected to both the cable and the workpiece.

Although several clamping devices have been devised and marketed in the past to permit a ground wire to be removably affixed to a pipe during the time that an electric welding operation is being performed thereon, the majority of these devices have maintained the ground wire in a fixed relationship with the pipe, with the result that as the pipe is rotated during a welding operation the ground wire become twisted and kinked. It will be apparent that such clamps are highly unsatisfactory, not only from the standpoint of damaging the ground wire due to twisting and kinking, but in diverting the welder's attention from his work to watching the ground wire to see that it is not twisted during the time the pipe is being rotated. Upon the second wire being kinked or twisted, it frequently is damaged by having one or more of the electrical conducting strands situated therein broken, with the result that the remaining strands in the cable are subjected to carrying a heavier electric load than that for which they are designed.

In most prior art devices, when the workpiece is rotated during welding, as in welding a circumferential seam in a pipe, the cable becomes wrapped around the workpiece. This wrapping makes such welding inconvenient due to the need to unwrap the cable or to move the clamp periodically.

Certain prior art devices have been suggested to avoid this problem. In U.S. Pat. No. 2,475,051 to Raymond, a ground connector is disclosed which is rigidly clamped by means of nuts to the work member. The connector is adapted to receive rounded apertured ends of a conductor, requiring an elaborate ball and spring arrangement to retain the conductive members in electrical contact.

In U.S. Pat. No. 2,642,560 to Elkens, a cable from a welding apparatus is clamped to a member rotatably mounted on the balance of a ground clamp by a ball bearing. Electrical contact occurs through the balls of the bearing.

In U.S. Pat. No. 3,058,082, an electrical connector is disclosed having a conductor connected to a connector, the electrical contact occurring from a disk rotating with the cable, to disked, resilient contact members.

It can be seen that Raymond, Elkins and Messerli are rather complicated devices of specific structure wherein electrical contact is provided through components that can easity become corroded in use or erode thus rendering such contact erratic.

There exists a need for an inexpensive ground clamp which can provide good, electrical contact between a workpiece and welding apparatus wherein the cable from the apparatus does not entangle during welding operations.

SUMMARY OF THE INVENTION

It is an object of this invention to provide a ground clamp which is connected to a workpiece which can be turned or rotated during welding without twisting of the ground conductor or cable that carries the welding current.

It is a further object of this invention to provide such a ground clamp that can be clamped to workpieces of differing configurations.

It is still another object of this invention to provide a ground clamp which is simple and durable and maintains good electrical contact.

These and other objects are preferably accomplished by providing a ground clamp which permits the workpiece to be rotated during welding while the portion of the clamp to which the cable is clamped remains substantially stationary so that the cable is not wrapped around the workpiece. The clamp may be secured to workpieces of differing configurations.

BRIEF DESCRIPTION OF THE DRAWING

FIG. 1 is a vertical view of a ground clamp in accordance with the invention, partly in cross-sectional, showing a workpiece in the form of a pipe connected thereto, and also the conductor of a welding apparatus coupled thereto;

FIG. 2 is a view taken along lines II—II of FIG. 1, a flat workpiece being substituted from the pipe workpiece of FIG. 1; and FIG. 3 is a cross-sectional view of one of the grounding vanes of the clamp of FIG. 1, taken along lines III—III thereof.

DESCRIPTION OF THE PREFERRED EMBODIMENT

Referring now to FIG. 1 of the drawing, a ground clamp 10 is shown having a main C-shaped body portion 11 and a threaded clamp bolt 12 extending through an aperture 13 in the upper leg 14 of body portion 11 terminating in a tapered end 15. End 15 is adapted to clamp a workpiece, such as one end of a pipe 16, which is to be welded, between upper leg 14 and lower leg 17. As will be discussed, lower leg 17 includes a U-shaped portion 18 (see also FIG. 2) enclosing therebetween a magnet-bearing insert 19 removably connected to leg 17 by means of one or more screws 20 threaded in suitable aligned apertures in both insert 19 and leg 17. Magnet 21 is carried by insert 19 and it can appreciate that insert 19 can be quickly removed from leg 17 and another insert screwed thereon should it become damaged, as by arcing or the like.

A T-handle 22 is provided at the upper end of clamp bolt 12 for facilitating tightening of bolt 17. A grounding vane 23 is pivotally and rotatably mounted on the portion of bolt 12 between T-handle 22 and a nut 24 threaded on bolt 12. Vane 23 is freely rotatable about a smooth portion 25 of bolt 12.

A second bolt 26 is threaded into a suitable aperture 27 in body portion 11 between legs 14 and 17. A second grounding vane 28 is rotatably and pivotally mounted on a smooth portion 29 of bolt 26 between head 30 and a nut 31 threaded thereon.

As shown particularly in FIG. 2, the vertical face of upper leg 14 facing away from body portion 11 is rasped or roughened, at face 32, to provide means for roughening the contacting surface of a workpiece prior to coupling clamp 10 thereto to provide a good electrical contact. Also, as shown in FIG. 2, the magnet 21 permits the clamp 10 to be magnetically coupled to a flat metallic workpiece 33 thus increasing the versatility of the clamp 10.

OPERATION

In operation, the pipe 16 to be welded is inserted between the jaws or legs 14, 17 of the body portion 11 of clamp 10 and secured to clamp 10 by tightening bolt 12 by turning T-handle 22 until tapered point 15 securely holds clamp 10 to workpiece 16. The vane 23, pivotally mounted on bolt 12, is then connected to the welding apparatus (not shown). This is accomplished by connecting cable or conductor 34, leading from the welding apparatus, to vane 23 by means of clamp 35. It can be appreciated that, if the workpiece 16 is turned or rotated during welding, for example, in a horizontal plane with respect to the surface of the drawing, bolt 12 rotates in vane 23 with vane 23 remaining substantially stationary so that cable 34 does not wrap around the workpiece 16. For convenience to fixing clamp 10 to workpieces of differing shapes, or in a different orientation, the second pivotally mounted vane 23 permits clamp 35', coupled to conductor 34', to be connected thereto thereby, for example, permitting workpiece 16 to be rotated in a vertical plane with respect to the drawing with vane 23 remaining substantially stationary, as shown in dotted lines in FIG. 1.

As shown in FIG. 2, magnet 21 permits the clamp 10 to be attached magnetically to surface 33, the conductor 34 being adapted to be connected to either vane 23, 28.

Preferably, the clamp 10 is made of suitable materials, such as stainless steel. The vanes 23, 28 and bolts 12, 26 may be made of copper or the like to provide good conductivity between conductor 34 and the workpiece 16.

It can be seen that I have described a unique and novel ground clamp which does not require elaborate and intricate components to provide electrical contact between a workpiece and welding apparatus while, at the same time, avoiding the problem of tangling of the welding apparatus conductor during welding operations.

I claim

1. A rotatable welding ground clamp comprising:

a main body portion forming upper and lower jaws of a clamp for securing a workpiece therebetween;

a rotatable bolt threadably mounted in one of said jaws having a handle at one end for rotating said bolt and a point at the other end extending between said upper and lower jaws for engaging a workpiece to thereby retain said workpiece between said point and the other of said jaws; and a vane freely rotatably mounted on said bolt between said handle and said one of said jaws on the outside of said body portion, said vane and said bolt being of electrically conductive material.

2. In the clamp of claim 1 wherein said legs are of metallic material and said one of said legs includes an outwardly facing roughened surface for filing a workpiece prior to connecting said clamp thereto.

3. In the clamp of claim 1 wherein said handle is a T-shaped handle having a central nut fixedly secured to said bolt and an elongated member integral with and extending from said central nut on both sides thereof in a direction generally normal to the longitudinal axis of said bolt.

4. In the clamp of claim 1 wherein said vane and said bolt are of copper, said body portion being of a metallic material, the portion of said bolt about which said vane rotates being generally smooth.

5. In the clamp of claim 1 wherein said bolt extends in a direction generally parallel to the plane of said body portion, said vane having a sleeve portion encircling said bolt and a vane portion extending in a direction generally normal to the longitudinal axis of said bolt.

6. In the clamp of claim 5 including a nut surrounding said bolt between said body portion and said vane.

7. In the clamp of claim 5 including a second bolt fixedly secured at one end to said body portion between said upper and lower jaws extending in a direction away from said body portion lying in generally the same plane and terminating in a bolt head, and a second vane pivotally and rotatably mounted on said second bolt between said bolt head and said body portion, said second bolt and said second vane being of electrically conductive material.

8. In the clamp of claim 7 including a nut surrounding said second bolt between said body portion and said second vane.

9. In the clamp of claim 1 wherein the other of said legs includes a downwardly extending U-shaped portion, said U-shaped portion having a magnet secured therein.

10. In the clamp of claim 9 wherein said magnet is removable from the other of said legs.

* * * * *